US005981916A

United States Patent [19]

Griffiths et al.

[11] Patent Number: 5,981,916

[45] Date of Patent: Nov. 9, 1999

[54] ADVANCED COOKING APPLIANCE

[75] Inventors: Simon P. Griffiths; Herbert G. Ray, both of Columbus, Miss.

[73] Assignee: Emerson Electric Co., St. Louis, Mo.

[21] Appl. No.: 09/095,919

[22] Filed: Jun. 12, 1998

[51] Int. Cl.[6] ..... H05B 1/02

[52] U.S. Cl. ..... 219/492; 219/506; 219/453; 219/497; 99/331; 99/333

[58] Field of Search ..... 219/492, 494, 219/497, 501, 506, 452, 453; 99/325, 329, 333, 331; 307/117, 119

[56] References Cited

U.S. PATENT DOCUMENTS

| | | | |
|---|---|---|---|
| 4,010,412 | 3/1977 | Forman | 323/18 |
| 4,214,151 | 7/1980 | Kecherer et al. | 219/492 |
| 4,553,011 | 11/1985 | Nakata et al. | 219/10.55 M |
| 4,692,597 | 9/1987 | Tsuda et al. | 219/492 |
| 5,293,028 | 3/1994 | Payne | 219/486 |
| 5,349,163 | 9/1994 | An | 219/492 |
| 5,809,994 | 9/1998 | Maher, Jr. | 219/492 |

*Primary Examiner*—Mark Paschall
*Attorney, Agent, or Firm*—Polster, Lieder, Woodruff & Lucchesi

[57] ABSTRACT

A cooking appliance includes a heating unit (10) for cooking food. The unit has a heating element (34) to which electrical current is supplied for generating heat used to cook food such as chocolate and sauces set upon the heating unit. A programmable controller (16) controls the application of current to the heating element to control the heating element temperature as a function of a time and temperature profile established for cooking the food in a particular manner. A temperature sensor (38) senses the heating element temperature and supplies a signal (St) to the controller. The characteristics of this signal are a function of the sensed cooking temperature. The controller is responsive to this signal, and other inputs (24,26) such as desired cooking time, and the amount and quantity of food, to vary the amount of current supplied to the heating element. The appliance is particularly useful in being able to heat chocolate, sauces, and the like without scorching them.

25 Claims, 4 Drawing Sheets

ADVANCED COOKING APPLIANCE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to appliances for cooking foods, and more particularly, to a control and control methodology for the appliance and heating units installed in the appliance to control operation of the heating units at turn-on and at other stages in a cooking cycle.

Electrical heating units, as is well-known in the art, comprise an electrical heating element such as a coil heating element, or a ribbon heating element. Heating units are available in different wattages and it is common for a cook top to have heating units of more than one wattage rating. The heating element is mounted on, or secured to, a cake of insulation material which, in turn, is fitted in a pan. The ends of the heating element connect through a thermal switch to an electrical circuit by which current is supplied to the heating element. The unit is installed beneath a heating surface upon which utensils are placed. Heat generated by the heating element is transferred to the heating surface by radiation, and from the heating surface to the utensil by conduction. The thermal switch includes a temperature sensing element which, if it senses the heating unit temperature exceeding a preset temperature, opens the switch and cuts-off current flow to the heating element. Besides this open loop arrangement employing the thermal switch, other heating unit controls employing temperature sensing have been tried. In coassigned U.S. Pat. No. 5,397,873, an electrical heating apparatus is described employing a temperature sensor installed in direct contact with a cooking surface. The apparatus is responsive to temperature changes at the cooking area to facilitate cooking food. However, heretofore, cooking appliances have not employed a closed loop temperature control system that can maintain the cooking temperature of food within a narrow range of temperatures about a user selected cooking temperature.

There are a number of problems with existing heating units. For example, it is now desirable that when current is first applied to the heating element that the heating element rapidly warm to a temperature at which the element starts to glow. The time for this to happen is approximately 3–5 seconds. While rapid heating is a desirable product feature, the current methods by which this is accomplished also shortens the life of the heating element.

In addition to rapid heating, another useful feature is the ability of the heating unit to simmer foods. The current test for simmering is to place a utensil with chocolate or a sauce on a heating unit and set the unit temperature to predetermined simmering temperature. It is a problem with current heating units that regardless of the temperature control scheme employed, the chocolate or sauce usually scorches. Better control of simmering so there is no scorching is therefore a desirable feature.

As noted, current heating units employ a temperature responsive limit switch which acts to cut-off power to a heating unit when a predetermined temperature is exceeded. The limit switch assembly is expensive, representing approximately 20–30% of the total cost of the heating unit. The limit switch assembly also is a primary source of heating unit failure. Elimination of the switch would not only be a substantial cost savings, but would also impact the service life of a heating unit; provided, that proper temperature control of the heating unit is still maintained.

BRIEF SUMMARY OF THE INVENTION

Among the several objects of the present invention may be noted the provision of an advanced heating unit for use in cooktops and the like for heating food. It is an important feature of the heating unit to actively control the temperature of the unit throughout the period when the unit is on. The heating unit allows rapid heating of a heating element to a desired temperature when power is first supplied to the unit; and, thereafter reduces the voltage to a second and lower level at which it is thereafter maintained.

Another object of the invention is an advanced unit in which the peak voltage supplied to the heating element is reduced at least 20% after the initial interval and is thereafter maintained at this reduced peak level. This extends the service life of the heating element.

A further object of the invention is an advanced heating unit in which the conventional temperature responsive limit switch is eliminated and a temperature sensor is used in its place. Besides the resulting cost savings and elimination of a primary source of unit failure, use of a temperature sensor allows the heating unit temperature to be constantly sensed. This, together with other information is provided to a controller which controls heating unit operation to quickly, conveniently, and properly cook food placed in a utensil set upon the unit.

Another object of the invention is a controller operable to control all phases of heating unit operation. To this end, the controller is programmable to provide a heating profile for rapid heating of foods, boiling water, simmering, etc. The controller is also provided various inputs including an output from the temperature sensor, the type and amount of food being heated, the cooking temperature, and cooking times. From this information, the controller controls heating unit operation in accordance with a predetermined profile. The controller is also responsive to the temperature sensor to shut off power to the heating element if the sensed heating unit temperature exceeds a predetermined level and to automatically restore power when the sensed temperature falls below that level.

A still further object of the present invention is an advanced heating unit used as original equipment on new cooking appliances. The heating unit is relatively low cost, yet is highly efficient and highly flexible for cooking food. The unit uses state-of-the-art heating elements and other advanced features similar to fuzzy logic and neural network techniques by which better control over the cooking process is attained.

In accordance with the invention, generally stated, a heating unit for cooking food comprises a heating element to which electrical current is supplied for generating heat used to cook food set upon the heating unit. A programmable controller controls the application of current to the heating element to control the heating element temperature as a function of a temperature profile established for cooking food in a particular manner. Factors determining the temperature profile for a particular cooking operation include the type of food, the amount, the cooking temperature, whether the food is to be boiled, simmered, reheated, etc. A temperature sensor senses the heating element temperature and supplies a signal to the controller. The characteristics of this signal are a function of the sensed temperature. The controller is responsive to this signal, as well as the other factors, to control the amount of current supplied to the heating element. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
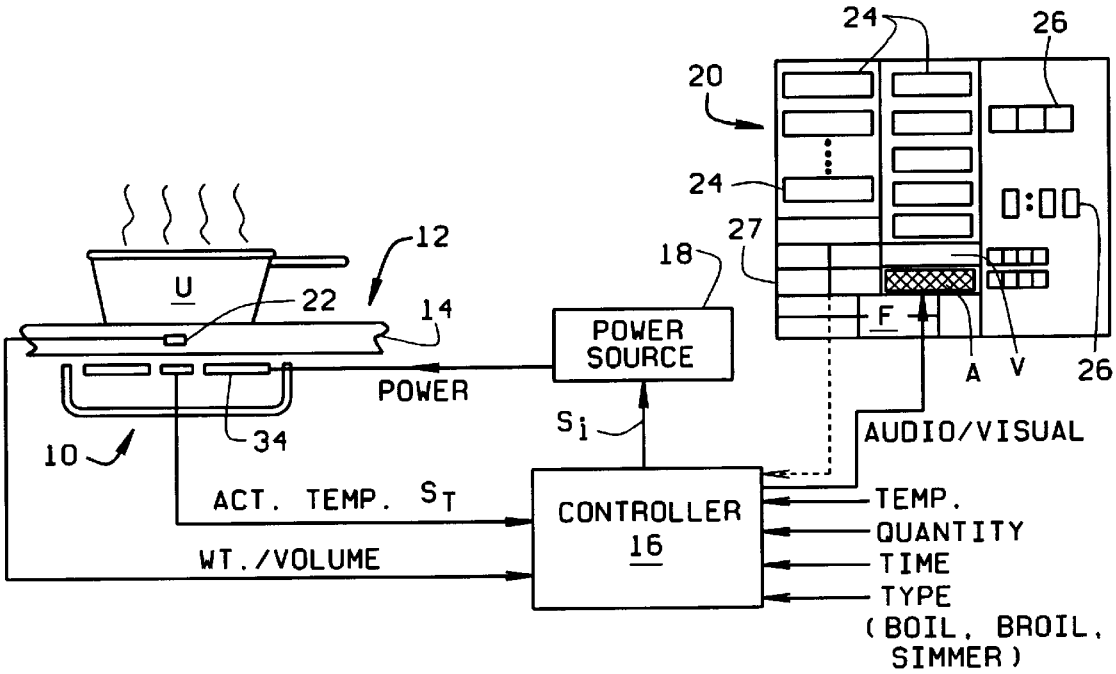
FIG. 1 is a simplified block diagram of the advanced heating unit control of the present invention.

Referring to the drawings, a heating unit 10 for heating food is shown in FIG. 1. The heating unit is described in detail with respect to FIGS. 2–4 and 5–7. Heating unit 10 is employed with a cooktop 12 of conventional manufacture. That is, the cooktop is installed on the top of a range or the like and includes a glass/ceramic surface 14 beneath which the heating unit is mounted. Although not shown, it will be understood that typically more than one heating unit is mounted beneath surface 14 and that usually some of the heating units are designed to have one wattage rating; while other of the heating units have a different wattage rating. Heretofore, someone desiring to cook food would place the food in a utensil U which is then set upon the top of the cooking surface over a heating unit. The user then turned a knob (not shown) to a position approximating the temperature to be provided by the heating unit. Electrical current flow to a heating element of the heating unit was controlled by the knob setting. The user then had to observe the status of the food to see if it had been cooked as desired. If, after an initial cooking time, the food was to remain warm or simmer, the user would change the knob position for a lower temperature and leave the utensil on the cooktop. Or, if the food was done, the utensil would be removed and the knob turned to an "off" position.

Figure 8:
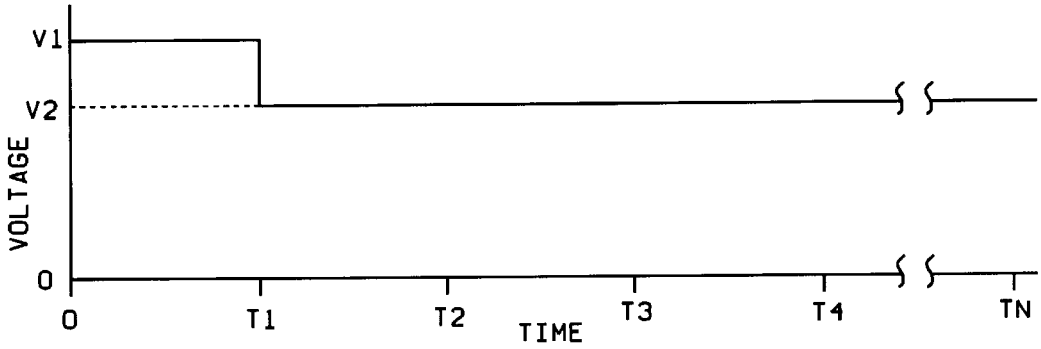
FIG. 8 is a voltage/time profile of the peak voltage level of the power supplied to a heating element of the heating unit.
Figure 9:
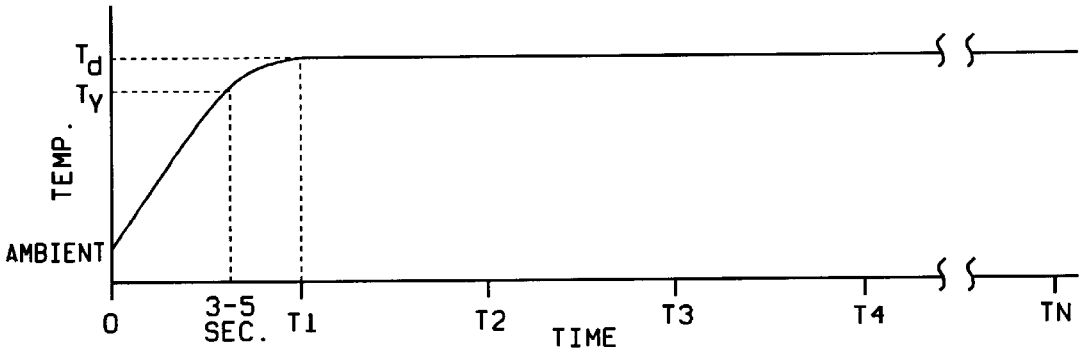
FIG. 9 is a temperature/time profile for the heating unit.

Over time, the requirements for heating have evolved to where better control over the operation of a heating unit is desirable. To this end, heating unit 12 of the present invention is usable with a controller 16 of the invention to meet the performance requirements now demanded by consumers, while at the same time providing a reliable and long lived product. Referring to FIGS. 8 and 9, a present requirement of heating units is rapid heat up to an operating temperature. This is evidenced by the heating element of the unit reaching the temperature within 3–5 seconds after application of power, by which time the heating element is glowing. The temperature profile shown in FIG. 9 reflects this requirement. As shown, at time 0, the temperature of the heating element is the ambient room temperature. As soon as power is applied to the heating element, the temperature quickly increases from ambient to a temperature Td which is the desired operating temperature of the heating unit. This desired operating temperature is reached at a time T1. As the heating element temperature rises to the desired temperature, it passes through a temperature $T_Y$ at which temperature the heating element begins to glow.

As shown in the voltage/time plot of FIG. 8, the rapid heat-up of the heating element is achieved by applying a voltage V1 across the heating element. This voltage which is, for example, 240 VAC has heretofore been applied across the heating element for the entire time the heating element is on. While such an application of power achieves the rapid heating, the tradeoff has been increased temperature stress on the heating element and a reduced service life. In accordance with the present invention, controller 16 includes a microprocessor programmable to control the voltage applied to a heating element of the heating unit in accordance with a predetermined profile. The profile is established so as to accomplish the rapid heating of the element, but to do so in a manner that serves to provide a longer service life. Accordingly, controller 16 first controls application of power to the heating element so the AC voltage applied has a peak value of V1. After the time interval T1 at which the heating element has reached its operating temperature, the controller reduces the peak applied voltage to level V2 which may be thereafter maintained. Voltage level V2 is, for example, 190 VAC which is approximately 10%–30% less than level V1. As shown in FIGS. 8 and 9, the reduced peak voltage input to the heating element can thereafter be maintained until the heating unit is turned off at a time $T_N$. This reduced peak voltage level is sufficient for the heating unit to stay at its desired operating temperature during that interval.

Figure 10:
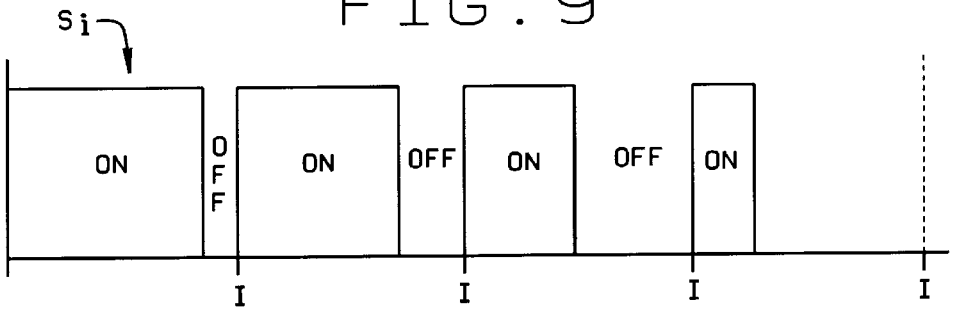
FIG. 10 is a mark space-plot representing the supply of current to the heating unit for the heating unit temperature to be controlled to a selected temperature.
Figure 11:
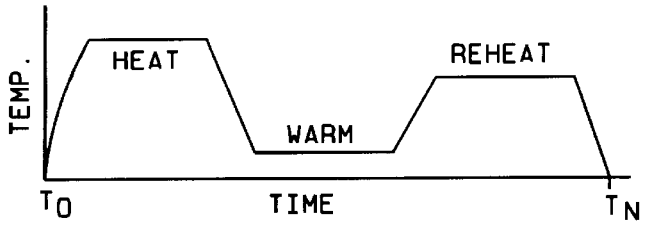
FIG. 11 represents a temperature time profile for cooking food.

In addition to operating with a rapid heat up to an operating temperature which is subsequently maintained, controller 16, as noted, further provides the capability to operate the heating unit in accordance with a predetermined temperature profile such as the profile shown in FIG. 11. The profile represents the ability of the advanced heating unit of the present invention to, for example, heat food at a given temperature, then lower the heating unit temperature to a warming or simmering temperature, and then, reheat the food prior to it being served. To accomplish this, and as shown in FIG. 10, controller 16 supplies a mark-space pulse input control signal Si to a power source 18 for the heating unit. This mark/space ratio of the signal can vary over a wide range of on/off ratios as shown in FIG. 10. The ratio at any one time controls the amount of time within a given time interval I that source 18 supplies current to heating unit 10. The greater the amount of on-time to off-time within an interval I, the longer current is supplied to the heating unit during that interval, and the higher should be the amount of heat produced by the heating unit during that interval.

Figure 12:
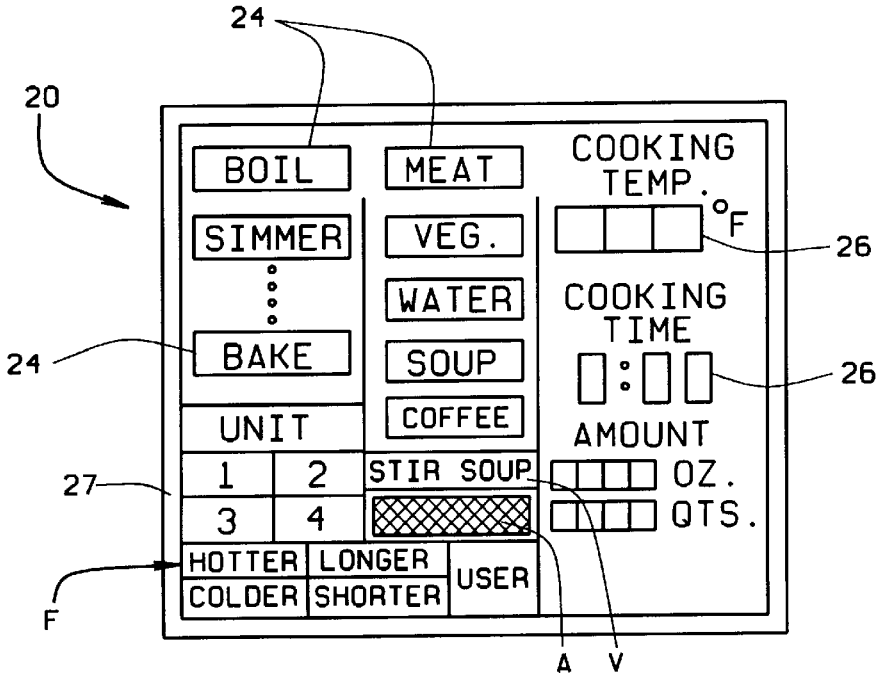
FIG. 12 illustrates a control panel by which a cook can select how food is to be cooked.

The actual on/off ratio is determined by an algorithm incorporated in controller 16 in response to the various inputs to the controller. These inputs include the type of food, the quantity, the cooking temperature, the length of time the food is to be cooked, the type of cooking (boiled, parboiled, broiled, baked, simmered, etc.), and the sensed temperature of the heating unit. All of this information can be entered by the person doing the cooking on a control panel 20 such as shown in FIG. 12. Or, if the person does not know some of the information such as the quantity or weight of the food, this can be provided by a sensor such as indicated at 22. Sensor 22 can measure the weight of food in a utensil U and provide that information to the controller. For common cooking situations, boiling water, heating coffee, etc., the controller can present a menu or list to the user and the user can simply select from the list by pushing a button 24 or entering a value as indicated at 26. The cook can also initiate a cooking procedure by pushing a sequence of buttons 24 and/or entering appropriate values. For example, Soup, Boil, and Simmer, would program the controller to bring whatever is in the utensil; soup, for example, to a boil, and then let the soup simmer at a lower temperature until it is time to serve it.

Regardless of the particular entry method employed, the result is to produce a profile executed by the controller. This capability is very beneficial when a variety of foods are being prepared, some of which must be cooked longer than others, and cooked in different ways. Controller 16 is capable of operating more than one heating unit, as indicated at 27; and because of this, the cook's task of timing when to start cooking one food or another, so all will be ready to serve at a particular time, is greatly simplified. By appropriately programming the controller, different foods are now cooked simultaneously, for the desired time, and in the desired manner, without the cook having to constantly check on each dish. As shown in FIG. 12, four heating units 1–4 are operable by the controller. The cook can separately program each heating unit from panel 20 knowing the controller will operate each unit in accordance with its programming. This is particularly advantageous, for example, where different courses of a meal (soup, entree, vegetable, dessert) are to be served at different times. In accordance with the invention, the cook can program the controller so the controller knows which foods related to each course are placed on which heating unit. Further, the cook can program the relative differences in time between the various courses. The controller will then automatically turn-on each unit at the appropriate time for the particular food being cooked on that unit, and cook the food in accordance with the temperature profile described above so each food is ready at the appropriate time. If a particular food needs attention (stirring, for example) at a particular point in its cooking cycle, controller 16 will provide appropriate audio and visual indications to the cook. Thus, as shown in FIGS. 1 and 12, controller 20 has a display panel V for visually displaying cooking instructions or other information, and an audio speaker A by which the instructions or other information is audibly communicated.

It is a further feature of the invention that controller 16 employs techniques similar to fuzzy logic techniques and neural network methodologies. Fuzzy logic, for example, enables different users of the stove to establish different cooking profiles for the same foods. Hot to one person may only be warm to another. Using fuzzy logic techniques, each user of the appliance can determine how they want their food individually prepared. Thus, using section F of control panel 20, each user can identify himself or herself and then indicate for each particular food or beverage prepared on the stove whether it should have been hotter or colder at the end of the cycle, or whether the cycle was too short or too long. Controller 16 is responsive to these inputs to adjust the cooking profile shown in FIG. 11 for that user and for that food or beverage. And, this is done without the user having to indicate how many degrees hotter or colder, or how much longer or how much shorter. Thereafter, each time that user indicates what food or beverage they want cooked, controller 16 will cause it to be cooked according to the temperature profile unique to that person.

The neural network technology incorporated in controller 16 allows the controller to be "trained" with respect to the types of utensils used with a heating unit, the types and quantities of foods cooked using those utensils, and idiosyncrasies of each cook using the appliance. Neural networks and network methodologies are well-known in the art. In the present application, a neural network implemented by controller 16 recognizes patterns of usage of the heating units. As a result, temperature profiles can be modified as appropriate so to provide the most efficient cooking of a food or beverage. So, if one heating unit performs slightly different from another, any differences are accounted for by appropriately modifying the time and temperature profile for food cooked on one heating unit as opposed to another.

Figure 2:
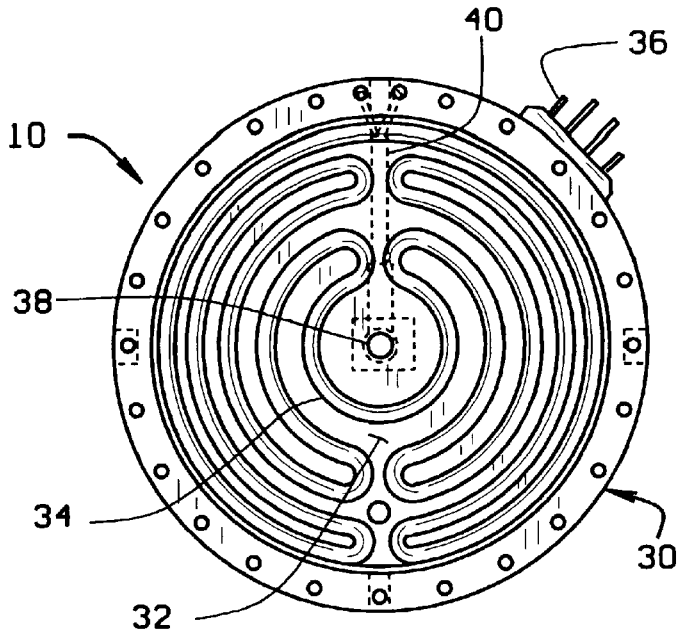
FIGS. 2–4 are respective top plan and side elevational views of a first embodiment of a heating unit for use with the present invention.
Figure 3:
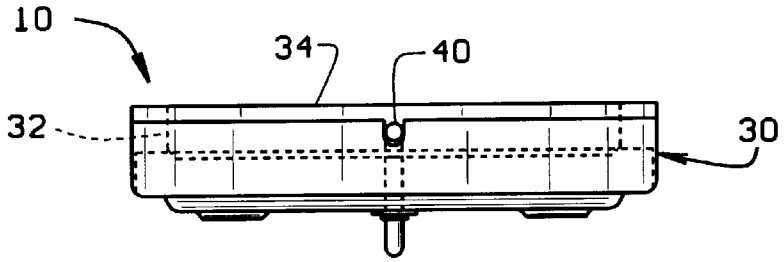
Figure 4:
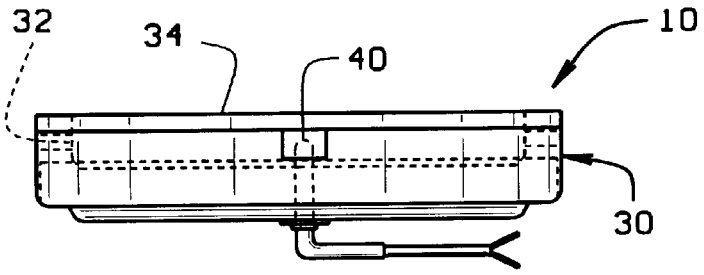

Referring to FIGS. 2–4, heating unit 10 is shown to include a pan 30 which is a shallow pan in which a cake 32 of an insulation material is supported. A heating element 34 is carried on the insulation material. The heating element is preferably a composition heating element such as described in copending, co-assigned U.S. patent application Ser. No. 908,755/08, filed Aug. 8, 1997, the teachings of which are incorporated herein by reference. The respective ends of the heating element are connected to power source 18 at a terminal block 36. Importantly, the heating unit employs a temperature sensor 38 the output of which is a temperature signal St supplied to controller 16. In FIG. 2, the temperature sensor is shown centered on the insulation material. Unlike previous heating units employing a temperature responsive switch which would cutoff power to a heating element if the unit temperature became too great, sensor 38 only provides a sensed temperature input to the controller via a cable 40. Controller 16 is responsive to signal St to perform a number of functions. If the temperature of the heating unit starts to increase above a selected heating value, controller 16 reacts by changing the mark-space ratio of the signal Si to power source 18. Thus, rather than shutting off the heating unit, the amount of heat produced during an interval can be altered by changing the amount of time current is supplied to heating element 34. This effectively lowers the amount of heat produced by the heating unit and the temperature to which a utensil placed upon the unit is heated. Temperature sensor 38, in conjunction with controller 16 is now able to effectively and continuously control the cooking temperature of food to the user selected temperature, or within a narrow range of temperatures about that temperature, or the selected time-temperature profile. Further, this feature is particularly important in preventing the scorching of foods because the response of controller 16 to the input of sensor 38 is almost instantaneous. Thus, if the sensed temperature starts to rise, the current input to the heating element is immediately effected, which lowers the heating unit temperature below that at which scorching occurs.

Figure 5:
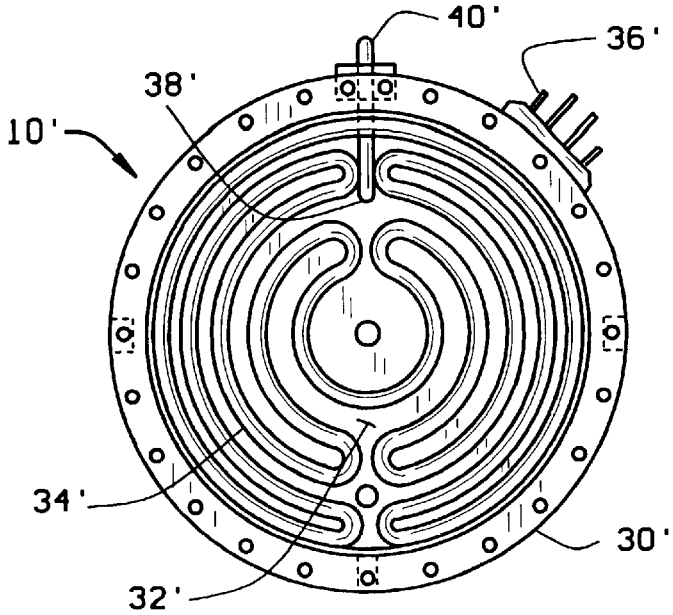
FIGS. 5–7 are respective top plan and side elevational views of a embodiment of a second heating unit for use with the present invention.
Figure 6:
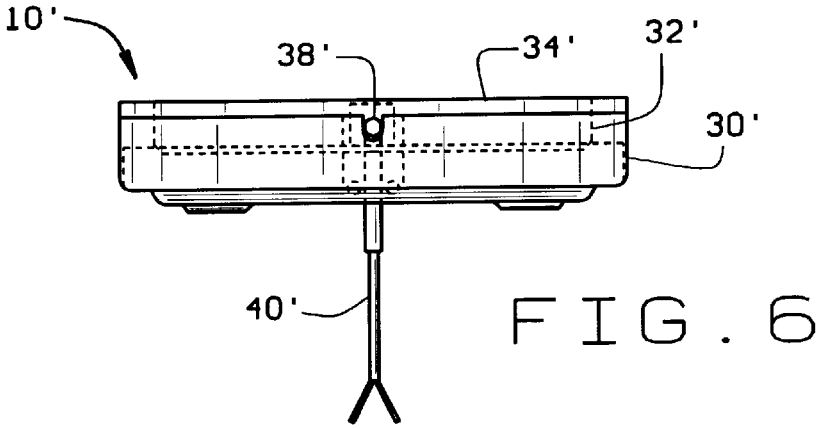
Figure 7:
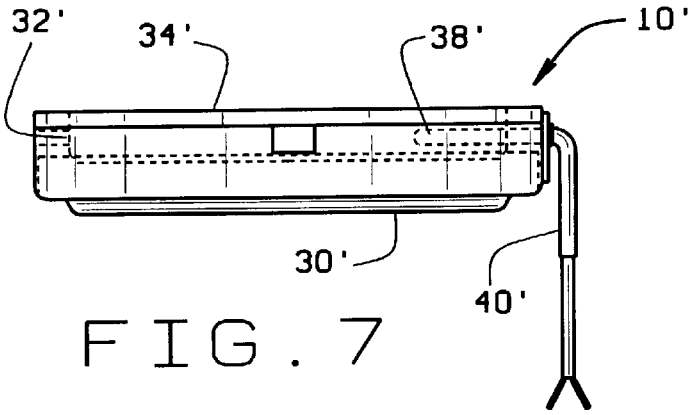

In FIGS. 5–7, an alternate embodiment of the heating unit is indicated 10'. Construction of this heating unit is the same as the heating unit 10 except that now, a sensor 38' rather than being centered on the heating unit is offset to one side. Operation of the sensor to provide a temperature signal St to the unit is still the same.

What has been described is a heating unit for cooktops and the like used to heat food and in which the temperature of the heating unit is actively controlled throughout the time the unit is on. A heating element of the unit rapidly heats to a desired temperature when power is supplied to the unit, but the applied voltage to the heating element is subsequently reduced to a lower level, and maintained there. This helps prolong the service life of the heating element. The amount of peak voltage reduction may be up to 20% of the initial voltage peak level. The heating unit employs a temperature sensor to constantly sense the temperature of the heating unit and any utensil placed on the unit. The sensed temperature level is provided as an input to a controller which controls application of power to the heating unit. The controller is programmable to include a temperature profile for the heating unit including temperatures which the heating unit produces for various cooking operations. Temperatures profiles are adjustable on the basis of fuzzy logic and neural network principles to customize the profile to individual users of the appliance, the utensils used, foods cooked, etc. The controller automatically adjusts power to the heating element based on this profile and other factors such as the amount of time food is to be cooked at a particular temperature. Separate heating units are separately programmable through the controller to allow different foods to be simultaneously prepared. Audio and visual aids are provided to assist the cook in his or her food preparation.

The controller is responsive to an input from the temperature sensor mounted on each heating unit to vary power to the heating element if the sensed heating unit temperature exceeds a predetermined level. This prevents scorching or overheating of foods being prepared. The advanced heating unit, including the temperature sensor and controller, can be used both as original equipment and as a replacement for conventional heating units. The appliance employs several heating units each of which is operable by the controller. The heating units are available with different power ratings.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. An appliance for cooking food, comprising:

a heating unit including a heating element to which electrical power is supplied for generating heat to cook food placed upon the heating unit;

a power source for supplying power to the heating element;

a closed loop temperature control system for actively controlling the temperature of the heating element by controlling operation of the power source, including a temperature sensor in thermal communication with the heating element for sensing instantaneous heating element temperature and generating a signal representative thereof, and a programmable controller in communication with the temperature sensor for controlling power supplied to the heating element by the power source based upon the signal generated by the temperature sensor, said power source supplying a first peak voltage to the heating element to rapidly increase the temperature of the heating element from an ambient temperature to a desired temperature during a first initial time period commencing when the appliance is turned on, and supplying a second reduced voltage having a voltage level less than the first peak voltage to the heating element after expiration of the first initial time period, said heating element being maintained at the desired temperature when the voltage level supplied to the heating element is reduced from the first initial voltage to the second reduced voltage.

2. The appliance as set forth in claim 1 wherein the voltage level of the second reduced voltage is at least 20% less than the voltage level of the first peak voltage.

3. The appliance as set forth in claim 1 wherein the first initial voltage is 240 VAC.

4. The appliance as set forth in claim 3 wherein the second reduced voltage is 190 VAC.

5. The appliance as set forth in claim 1 wherein the heating element emits a glow during the first time interval to visually indicate the temperature of the heating element is approaching the desired temperature.

6. The appliance as set forth in claim 5 wherein the heating element emits the glow within at least five seconds of the first time interval.

7. The appliance as set forth in claim 1 wherein said controller is programmable to provide a predetermined heating profile for each of a plurality of foods to be cooked in a particular manner, said controller controlling power supplied to the heating element based upon the heating profile for a particular food to be cooked.

8. The appliance as set forth in claim 7 furthering including input means allowing a user to input information representative of the heating profile for the particular food to be cooked, said controller controlling power supplied to the heating element based upon the food information input by the user.

9. The appliance as set forth in claim 8 wherein the food information is representative of a type of food being cooked.

10. The appliance as set forth in claim 9 wherein the food information is representative of a quantity of food being cooked.

11. The appliance as set forth in claim 8 wherein said input means further allows the user to input cooking information representative of a desired temperature for cooking the food and a desired time period for cooking the food, said controller controlling power supplied to the heating element based upon the cooking information.

12. The appliance as set forth in claim 1 wherein said controller shuts off power supplied to the heating element by the power source when the sensor detects a temperature exceeding a predetermined maximum temperature, and said controller restores power supply to the heating element by the power source when the temperature detected by the sensor falls below the maximum temperature.

13. An appliance for cooking food, comprising:

a heating unit including a heating element for generating heat to cook food placed upon the heating unit;

a power source for supplying power to the heating element;

a temperature sensor in thermal communication with the heating element for sensing heating element temperature and generating a signal representative thereof, and a programmable controller in communication with the temperature sensor for actively controlling the temperature of the heating element by controlling supply of power to the heating element from the power source based upon signals generated by the temperature sensor and a user defined cooking profile for the particular food being cooked; and input means allowing the user to input information representative of the cooking profile, said cooking profile including information representative of at least one desired temperature for cooking the food and a desired time interval during which the desired temperature is to be maintained.

14. The appliance as set forth in claim 13 wherein said cooking profile includes user defined information representative of a first desired temperature at which the heating element is to be maintained for a first desired time interval, and a second desired temperature at which the heating element is to be maintained for a second desired time interval upon expiration of the first time interval.

15. The appliance as set forth in claim 14 wherein said cooking profile further includes user defined information representative of a third desired temperature at which the heating element is to be maintained for a third desired time interval upon expiration of the second time interval.

16. The appliance as set forth in claim 15 wherein said controller controls power supplied to the heating element by the power supply to allow the food to be cooked at a first temperature for a first time interval, simmered at a second temperature for a second time interval, and reheated at a third temperature for a third time interval.

17. The appliance as set forth in claim 13 wherein the cooking profile further includes information representative of a particular type of food being cooked.

18. The appliance as set forth in claim 13 wherein the cooking profile further includes information representative of a particular quantity of food being cooked.

19. The appliance as set forth in claim 13 wherein the cooking profile further includes information representative of a manner in which the food is to be cooked.

20. The appliance as set forth in claim 13 wherein said controller causes a first peak voltage to be supplied to the heating element by the power source to rapidly increase the temperature of the heating element from an ambient temperature to a desired temperature during an initial first time period commencing when the appliance is turned on, and a second reduced voltage having a voltage level less than the first peak voltage to be supplied to the heating element by the power source after expiration of the initial first time period, said heating element being maintained at the desired temperature when the voltage level supplied to the heating element is reduced from the first initial voltage to the second reduced voltage.

21. A closed loop temperature control system for an appliance for cooking foods, comprising a heating element for generating heat to cook food;

a power source supplying power to the heating element;

a temperature sensor for sensing heating element temperature and generating a signal representative thereof, and a controller electrically connected to the temperature sensor and the power source for controlling power supplied to the heating element by the power source based upon signals generated by the temperature sensor, said controller being programmable to cook food in accordance with a predefined time and temperature cooking profile for a particular food to be cooked by which power is supplied to the heating element by the power source under control of the controller to maintain heating element temperature at a first desired temperature for a first predetermined time interval and at a second desired temperature for a second predetermined time interval.

22. The closed loop cooking system as set forth in claim 21 further including input means in communication with the controller allowing a user to input data representative of the cooking profile, including information representative of the first temperature, the first time interval, the second temperature and the second time interval.

23. A method of cooking foods comprising the steps of:

placing a utensil in which food is contained on a heating unit having a heating element for generating heat to cook the food;

supplying power to the heating element;

sensing an instantaneous temperature of the heating element; and controlling power supplied to the heating element in response to the sensed temperature to maintain the heating element temperature at a predetermined first temperature for a predetermined first time interval and at a predetermined second temperature for a predetermined second time interval commencing after expiration of the first time interval.

24. A method of cooking foods comprising the steps of:

placing a utensil in which food is contained on a heating unit having a heating element for generating heat to cook the food;

turning on the heating unit to supplying power to the heating element;

sensing an instantaneous temperature of the heating element; and controlling power supplied to the heating element in response to the sensed temperature to maintain the heating element temperature at a predetermined temperature by supplying a first peak voltage to the heating element to rapidly increase the heating element temperature during an initial time interval commencing when the appliance is turned on and supplying a second reduced voltage to the heating element having a voltage level less than a voltage level of the first peak voltage after expiration of the initial time interval.

25. An appliance for cooking food comprising:

a heating unit including a heating element to which electrical power is supplied for generating heat used to cook food placed upon the heating unit;

a power source supplying power to the heating element; and, a closed loop temperature control system controlling initial application of power to the heating unit so to achieve a rapid visual response from the heating element, and to thereafter regulate power to the heating element both to cook food at temperatures at an upper end of a range of cooking temperatures and to simmer food at a lower end of said range of temperatures, the system controlling operation of the heating unit as a function of the temperature produced by the heating element so to both properly cook food, and to prevent scorching of food being simmered.

* * * * *